US008479799B2

(12) United States Patent
Hügin

(10) Patent No.: US 8,479,799 B2
(45) Date of Patent: Jul. 9, 2013

(54) LOUVER BLIND HAVING MAGNETIC MOUNT

(75) Inventor: Walter Hügin, Rickenbach-Altenschwandt (DE)

(73) Assignee: Trietex Antriebstechnik GmbH, Efringen-Kirchen (DE)

( * ) Notice: Subject to any disclaimer, the term of this patent is extended or adjusted under 35 U.S.C. 154(b) by 346 days.

(21) Appl. No.: 12/812,303

(22) PCT Filed: Dec. 10, 2008

(86) PCT No.: PCT/EP2008/010667
§ 371 (c)(1),
(2), (4) Date: Nov. 8, 2010

(87) PCT Pub. No.: WO2009/086883
PCT Pub. Date: Jul. 16, 2009

(65) Prior Publication Data

US 2011/0056631 A1 Mar. 10, 2011

(30) Foreign Application Priority Data

Jan. 9, 2008 (DE) ..... 10 2008 003 718

(51) Int. Cl.
*E06B 9/388* (2006.01)

(52) U.S. Cl.
USPC ..... 160/176.1 V; 160/177 V; 160/178.1 V; 49/74.1

(58) Field of Classification Search
USPC ..... 160/172 V, 172 R, 168.1 R, 176.1 R, 160/178.1 V; 49/74.1
See application file for complete search history.

(56) References Cited

U.S. PATENT DOCUMENTS

| | | | | | |
|---|---|---|---|---|---|
| 2,625,219 | A | * | 1/1953 | Peck | 160/168.1 V |
| 3,524,281 | A | * | 8/1970 | Streeter, Jr. | 49/74.1 |
| 3,742,648 | A | * | 7/1973 | Streeter, Jr. | 49/74.1 |
| 3,862,655 | A | * | 1/1975 | Knapper | 160/172 V |
| 5,467,808 | A | * | 11/1995 | Bell | 160/168.1 P |
| 5,501,261 | A | * | 3/1996 | Peale | 160/168.1 R |
| 5,718,274 | A | * | 2/1998 | Streeter | 160/176.1 P |
| 5,967,217 | A | * | 10/1999 | Wu | 160/331 |
| 2011/0056631 | A1 | * | 3/2011 | Huegin | 160/174 V |

FOREIGN PATENT DOCUMENTS

DE 7539579 U 4/1976

* cited by examiner

*Primary Examiner* — Blair M. Johnson
(74) *Attorney, Agent, or Firm* — Gifford, Krass, Sprinkle, Anderson & Citkowski, P.C.

(57) ABSTRACT

The invention relates to a louver blind having louvers (1) that can be pivoted about a vertical axis, displaceably held at both ends thereof by louver holders (2) extending beyond the louver width between an upper and a lower guide track (3). The louver holders (2) are hereby connected to each other by carriages (4) displaceable in the guide tracks (3) and aligned in parallel to each other, and can be pivoted by synchronously driven drive device disposed in the carriages (4). In order to make the installation of the louver blind—or optionally the removal thereof—easier, according to the invention, decoupleable permanent magnets (16, 18) are provided for connecting between the louver mounts (2) and the carriages (4). Said arrangement has the further advantage that the connections can automatically release when critical tension or rotational forces are exceeded, so that damage can be prevented in the connecting parts.

9 Claims, 5 Drawing Sheets

LOUVER BLIND HAVING MAGNETIC MOUNT

CROSS-REFERENCE TO RELATED APPLICATIONS

Figure 1:
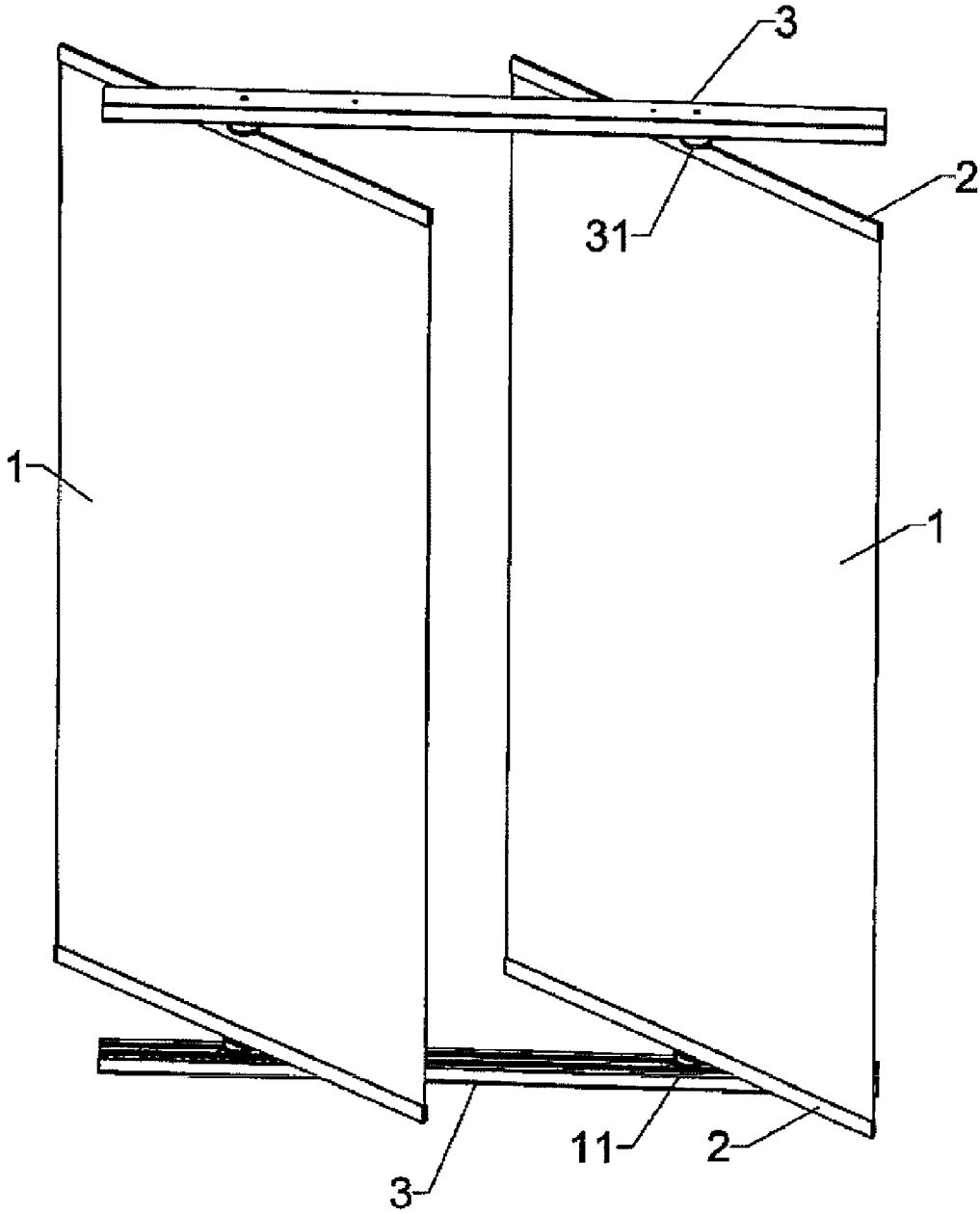

This application is the U.S. national phase of PCT/EP2008/010667 filed Dec. 10, 2008, which claims priority to DE 10 2008 003 718.4 filed Jan. 9, 2008.

FIELD OF THE INVENTION

The invention relates to a louver blind with louvers that can pivot about a vertical axis and that are held at their two ends by louver holders extending across the louver width so that they can move between an upper and a lower guide track, wherein the louver holders are connected aligned parallel to each other to carriages that can move in the guide tracks and can pivot by means of synchronously driven rotating means arranged in the carriages.

BACKGROUND OF THE INVENTION

Louver blinds are used in architecture to protect buildings and their users from the undesired effects of intense solar irradiation. Simultaneously, however, a high degree of transparency should remain. For this purpose, the louvers must be mounted in carriages so that they can pivot such that, in the state when they are moved apart from each other, these can each be rotated perpendicular to the incident solar irradiation.

Louver blinds of the type named above are known, for example, from DE 75 39 579 U. Here, the louver holders and the gear devices arranged in the carriages are connected rigidly to each other. The production of this connection requires special effort in terms of assembly and also makes any repair work more difficult, for example, when changing out particularly wide louvers, like those being used increasingly for facades with large surface-area glass windows.

The task of the invention is to form the connection between the louvers and the carriages so that both the assembly of the louver blinds and also repair work on the louvers can be performed more easily. In addition, the connections should automatically disconnect when critical tensile forces or torques are exceeded, in order to prevent damage to the connecting parts.

SUMMARY OF THE INVENTION

To achieve this task, it is proposed according to the present invention that the connection between the louver holders and the carriages is produced by permanent magnets that can be decoupled.

This can be achieved advantageously in that the rotating means in the carriage are locked in rotation with a rotary plate projecting from the slot of the guide tracks that is open to the louvers, wherein the magnets are mounted in radial alignment on this rotary plate, and a magnet holder is mounted on the louver holders opposite each rotary plate, wherein this magnet holder is equipped with counter magnets of corresponding strength for producing the connection to the magnets of the rotary plate.

In this way, not only is the assembly made easier, but it can also be achieved that, for the case of the unintentional appearance of torque or tensile stresses that lead to the detachment of the coupling connection, the magnets easily disconnect from each other and automatically rejoin when the disconnection forces are eliminated. Such stresses can then occur, for example, when a window washer inserts his ladder between louvers that are arranged at a right angle for cleaning large surface-area windows, in order to reach the windowpanes, and, in this way, pushes against the louver holders.

BRIEF DESCRIPTIONS OF THE DRAWINGS

Figure 2:
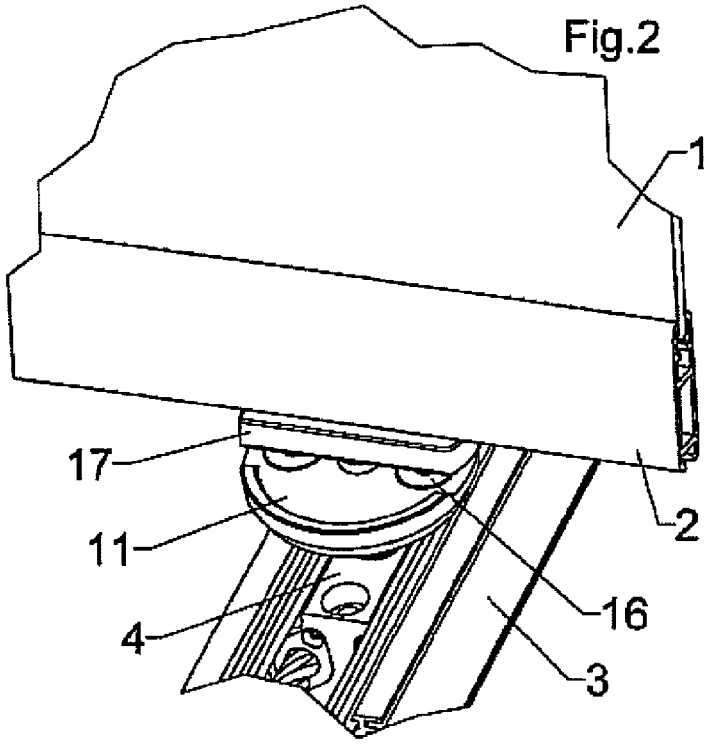
Figure 3:
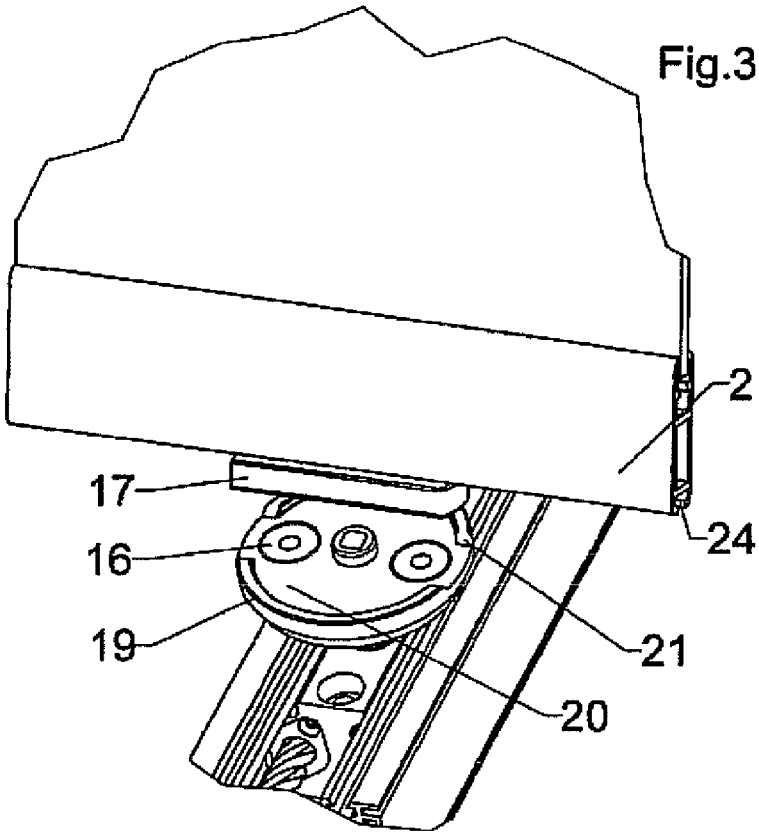
Figure 4:
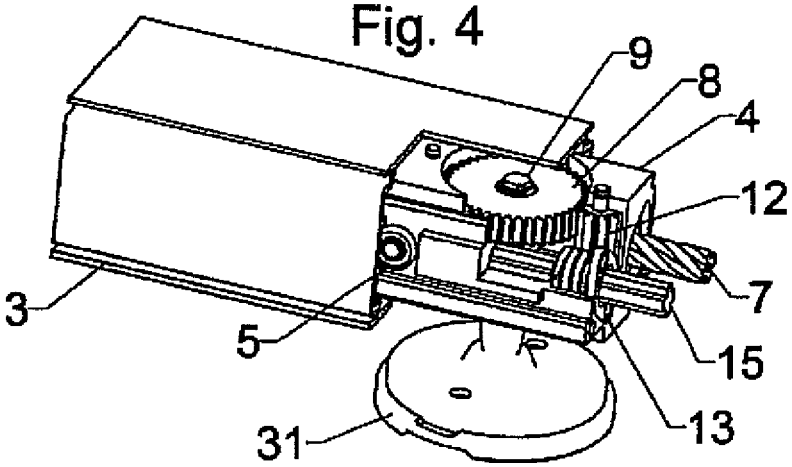
Figure 7:
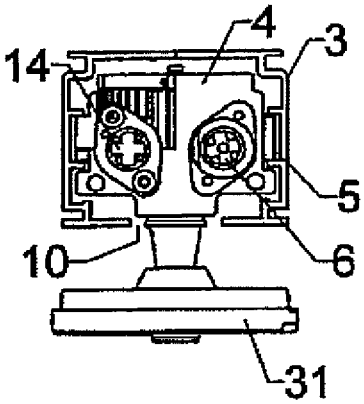
Figure 5:
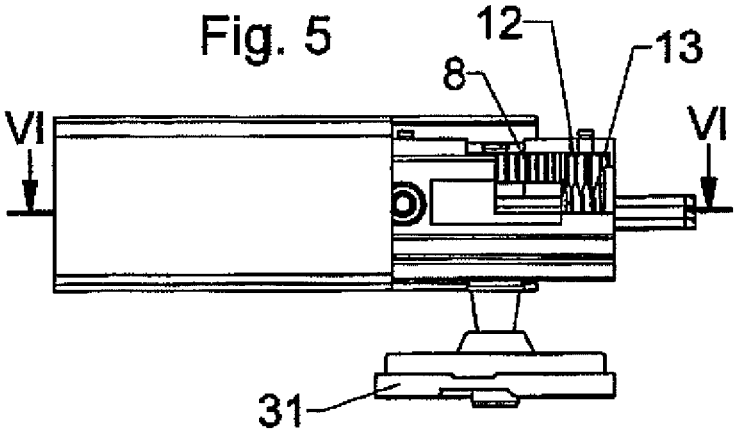
Figure 6:
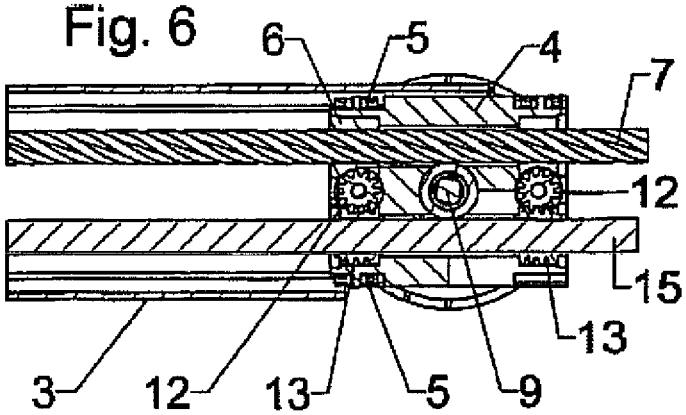
Figure 8:
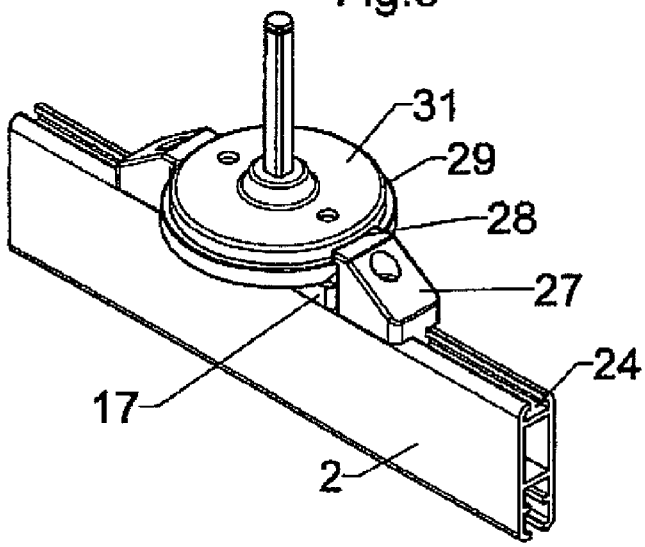
Figure 10:
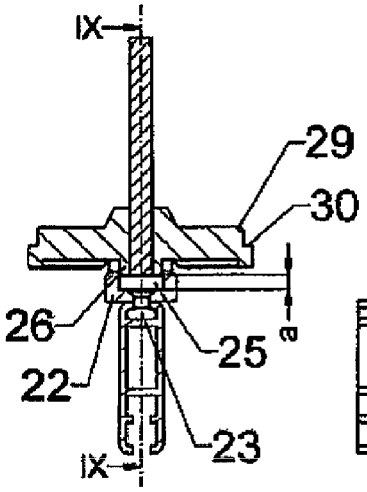
Figure 9:
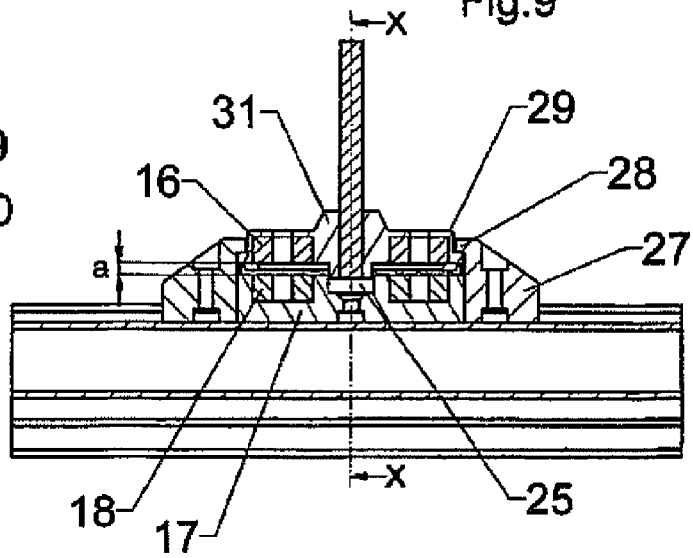
Figure 12:
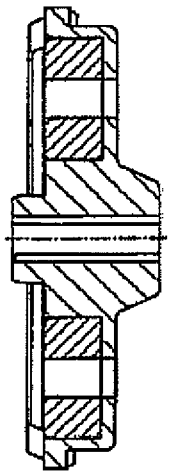
Figure 11:
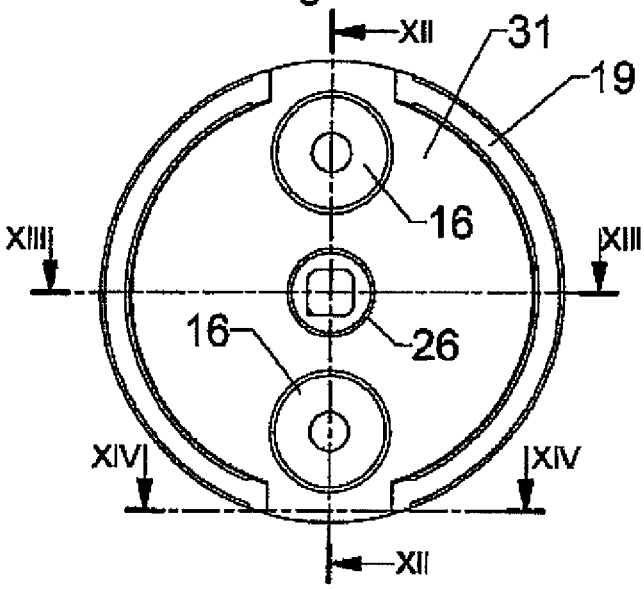
Figure 14:
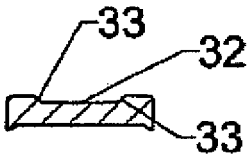
Figure 13:
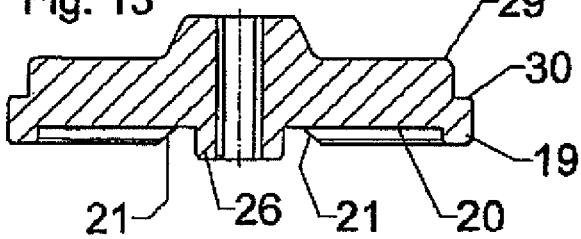
Figure 16:
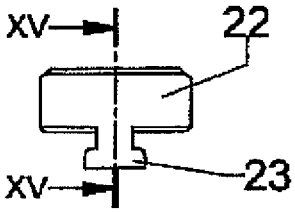
Figure 15:
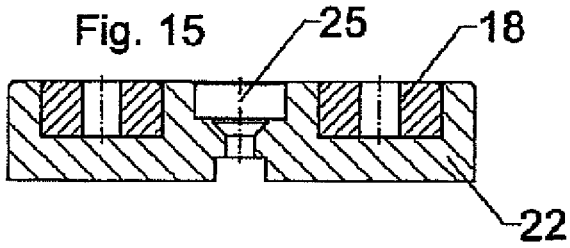
Figure 17:
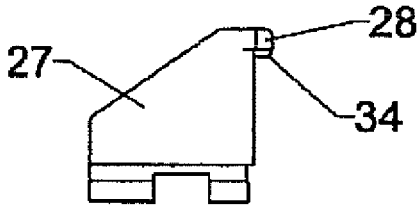

Additional features of the invention and their advantages follow from the subordinate claims and the explanation of a preferred embodiment of the invention that is shown in the drawings and that shall be described in detail below. Shown herein are:

FIG. 1, a louver blind with louvers moved apart from each other and arranged at an angle to the window;

FIG. 2, the lower guide track with rotary plate when coupled with the magnet plate in a perspective top view;

FIG. 3, the same picture with a decoupled magnet holder;

FIG. 4, the upper guide track with carriages and rotary plates in a perspective diagram with a view into the gear;

FIG. 5, the same picture in side view;

FIG. 6, the same picture in longitudinal section according to line VI-VI in FIG. 5;

FIG. 7, a front view of FIG. 5;

FIG. 8, the upper louver holder with rotary plates and chocks assembled together in a perspective view from above;

FIG. 9, the upper louver holder with decoupled rotary plates in longitudinal section according to line IX-IX in FIG. 10;

FIG. 10, a cross section in this respect according to line X-X in FIG. 9;

FIG. 11, an upper rotary plate in top view with a view of the magnets;

FIG. 12, the rotary plate in section according to line XII-XII in FIG. 11;

FIG. 13, the rotary plate in section according to line in FIG. 11;

FIG. 14, a section through the edge of the plate according to line XIV-XIV in FIG. 11;

FIG. 15, the magnet holder in section according to line XV-XV in FIG. 16;

FIG. 16, the same magnet holder in front view;

FIG. 17, a chock in side view; and

Figure 18:
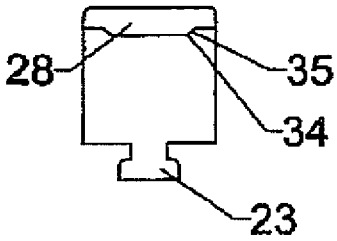

FIG. 18, the same chock in front view with view of the projection.

DETAILED DESCRIPTION OF THE INVENTION

The louver blind shown in the figures is equipped with louvers 1 that can pivot about a vertical axis. The louvers 1 are held at their two ends by louver holders 2 that usually extend across the entire louver width. These louver holders 2 are held so that they can move and pivot on their side between an upper and a lower guide track 3, wherein the louver holders 2 are connected to each other with carriages 4 that can move in the guide tracks 3 in a way still to be described by means of permanent magnets 16 and 18.

In FIGS. 4-7, the configuration of a carriage 4 with a gear housed in this carriage for pivoting the louvers 1 is shown clearly and shall be explained in detail below—as much as necessary for understanding the invention.

The carriage 4 is here guided so that it can move in the guide track 3 by means of laterally mounted track rollers 5. For movement, in the front carriage 4, a threaded sleeve 6 with large thread pitch is fit in the longitudinal direction, with a threaded rod 7 with the same thread pitch being guided through this sleeve. The threaded rod 7 is driven by a motor arranged at the beginning of the guide track 3, in order to move the front carriage 4 in the longitudinal direction. The following carriages 4 are then pulled along by typical spacers.

The gear installed in the carriage 4 is made essentially from a toothed wheel 8 that is mounted vertically in the center of the carriage 4 and that projects downward with a rotating rod 9 through an open slot 10 in the guide track 3, with this rotating rod being locked in rotation, in turn, with a rotary plate 11 or 31. The toothed wheel 8 engages in vertically mounted pinions 12 that are driven on their side by worms 13 mounted in the carriage 4 at the side of the pinion 12.

Here it has proven useful to drive the toothed wheel 8 by means of two diametrically opposed pinions 12 and two worms 13, in order to keep the structural height of the carriage 4 as small as possible.

The worms 13 are provided with a crossed slot 14 through which a rotating rod 15 is inserted that is shaped corresponding to the profile of the slot 14. This rotating rod 15 is guided through the worms 13 of several carriages 4 arranged one after the other and is connected to a motor at the beginning of the guide track 3. Therefore, the rotary plate 11 or 31 of all of the carriages 4 can be pivoted in sync by the same angle.

In FIGS. 2 and 3, the effect according to the invention of the magnet connection between a lower louver holder 2 and a lower rotary plate 11 locked in rotation with the carriage 4 is shown, with this rotary plate having two diametrically opposed permanent magnets 16 in radial alignment relative to the louver holder 2. On the bottom side of the louver holder 2, a magnet holder 17 is mounted above the rotary plate 11, wherein this magnet holder is equipped with counter magnets 18 of corresponding strength for producing the connection to the magnets 16 of the lower rotary plate 11.

On its edge, the lower rotary plate 11 has—just like the upper rotary plate 31 in FIGS. 8-10 and 11-13—a ring 19 that is directed toward the magnet holder 17 and that is notched in the radial projection of the magnets 16 up to the plate base 20 at the width of the magnet holder 17. In this way, the notch faces 21 are directed outward at an angle from the plate base 20, so that the magnet holder 17 can rotate upward along the inclined faces 21 and in this way can be simultaneously decoupled for an unexpected rotating force on the louver holder 2.

The magnet holder 17 is made from an elongated base body 22, as can be seen from FIGS. 15 and 16, in which the two counter magnets 18 are embedded at the same spacing as the magnets 16 in the lower rotary plate 11. On its bottom side, the base body 22 has a projection 23 that has a T-shaped cross section and that is inserted into a correspondingly shaped groove 24 on its bottom edge for connecting to the louver holder 2 and that is anchored in the center of the louver holder 2.

In the center of the base body 22, a circular recess 25 is formed in which engages a round peg 26 fixed on the lower rotary plate 11 in the center between the two magnets 16 in the coupled state. This round peg 26 ensures that, after the appearance of the previously mentioned rotational effect and the decoupling dependent on this effect, the centering of the magnet holder 17 relative to the rotary plate 11 is maintained, so that after the rotational effect is eliminated, the magnet holder 17 can be docked again without a problem. Obviously, the intentional centering effect could then also be achieved when the recess 25 is provided as in FIG. 13 on the upper rotary plate 31 and the associated round peg 26 as in FIG. 15 on the magnet holder 17.

While just the force of gravity is responsible for the coupling situation at the lower end of the louvers 1, in which, after the louver holder 2 drifts away, the magnet holders 17 dock on the rotary plates 11 again due to magnetic forces, additional measures must be taken at the upper end of the louvers 1, as can be seen from FIGS. 8-10, so that the louver holder 2 does not fall downward due to unexpected appearance of tensile or torque forces after the disconnection of the magnet connection.

Therefore, on the upper louver holders 2 on both sides of the upper rotary plate 31, chocks 27 are provided with inward-directed projections 28 that have the same T-shaped projections 23 as the magnet holders 17. These chocks 27 are pushed with their projections 23 on both sides of the rotary plate 31 into the grooves 24 on the lower edge of the louver holder 2 and anchored in the groove 24 shortly before contact on the rotary plate 31. In this way it is achieved that the projections 28, as can be seen from FIG. 8, engage behind the rotary plate 31 in the coupled state of the magnets 16 and 18 with a safety spacing "a". When the upper rotary plate 31 is decoupled from the magnet holder 17 by the unexpected effect of tensile or torque forces, it can fall downward only by the safety spacing "a" and is then held by the projections 28 (FIG. 9).

The upper edge 29 of the upper rotary plate 31 is here preferably offset inward by a radial step 30 corresponding to the radial dimension of the projections 28 (see FIGS. 10 and 13). In order to also achieve the most centered position possible here after the decoupling, the radial step 30 of the upper rotary plate 31 is provided underneath the projections 28 with recesses 32 corresponding to the width of the chocks 27 (see FIGS. 11 and 14).

Similar to the notch faces 21 in the ring 19, here the notch faces 33 are also directed outward at an angle from the base of the recesses 32, while the projections 28 of the chocks 27, as can be seen from FIGS. 17 and 18, have counter faces 35 that are directed inward at an angle corresponding to their engagement edges 34 and that engage in the recesses 32 of the step 30 in the decoupled state of the magnet holder 17.

In addition it shall be noted that the upper rotary plates 31 differ from the lower rotary plates 11 in shape only by the additional formation of radial steps 30 on the upper edge 29 and recesses 32 in the steps 30 that are provided for the interaction with the chocks.

It is understood that the upper rotary plates 31 can also be used on the lower end of the louvers 1, in order to eliminate a second shape for the rotary plate 11 or else in order to be able to also insert the same chocks 27 at the lower end of the louvers 1 in the louver holder 2, if all that matters is protection against decoupling due to the effect of torque forces.

It is further understood that the characterizing features of the invention can also be used in such louver blinds in which the vertically directed louvers 1 are held so that they can move and pivot only at their upper ends with their louver holders 2 on an upper guide track 3, when a lower guide track can be eliminated or if the upper guide track runs at an angle, because the window frame is beveled at the top.

It is also understood that the connection according to the invention between the louver holders 2 and the carriages 4 can also relate completely generally to louver blinds in which the louvers 1 are held so that they can pivot about their louver axis between two parallel guide tracks 3, regardless of whether the guide tracks are arranged vertically, horizontally, or at an angle in space.

It is claimed:

1. A louver blind with louvers that can pivot about a vertical axis and that are held at their two ends by louver holders extending across the louver width so that they can move between an upper and a lower guide track, wherein the louver holders are arranged parallel to each other with carriages that can move in the guide tracks and can pivot by means of synchronously driven rotating means arranged in the carriages, and wherein the connection between the louver holders and the carriages is created by permanent magnets that can be decoupled, wherein the rotating means in the carriage are locked in rotation with a rotary plate that projects from a slot of the guide tracks open to the louvers and on which the magnets are fixed in a radial alignment, and in that a magnet holder that is equipped, for creating the connection to the magnets of the rotary plate, with counter magnets of corresponding strength is mounted on the louver holders opposite the rotary plates.

2. The louver blind according to claim 1, wherein each rotary plate has, on its edge, a peripheral ring that is directed toward the magnet holder and that is notched in the radial projection of the magnet up to the plate base at the width of the magnet holder.

3. The louver blind according to claim 2, wherein the notched surfaces are directed outward at an angle from the plate base.

4. The louver blind according to claim 3, wherein a circular recess is set in the center of the rotary plate or the magnet holder, wherein, in the coupled state, a round peg placed on the bottom side of the magnet holder or rotary plate engages in this recess.

5. The louver blind according to one of claims 1, wherein chocks with inward-directed projections that engage behind the rotary plate in the coupled state of the magnets and with a safety distance "a" are mounted on the upper louver holders on both sides of the rotary plate.

6. The louver blind according to claim 5, wherein the upper edge of the rotary plate is offset inward by a step corresponding to the radial dimension of the projections.

7. The louver blind according to claim 6, wherein the radial step underneath the projections is provided with recesses corresponding to the width of the chocks.

8. The louver blind according to claim 7, wherein the notched surfaces of the recesses are directed outward at an angle, while the projections of the chocks have, on their engagement edges, corresponding inward-directed counter faces that engage, in the decoupled state of the magnet holder, in the recesses of the step.

9. The louver blind according to claim 1, wherein each rotary plate is connected by means of a rotating bar to a toothed wheel that is mounted vertically in the carriage and that is driven by means of two diametrically opposed pinions and two worms engaging in the pinions.

* * * * *